US011449006B2

(12) United States Patent
Leskerpit et al.

(10) Patent No.: US 11,449,006 B2
(45) Date of Patent: Sep. 20, 2022

(54) MOVING MECHANISM FOR A DECORATIVE ELEMENT OF A TIMEPIECE

(71) Applicant: Montres Jaquet Droz SA, La Chaux-de-Fonds (CH)

(72) Inventors: Julien Leskerpit, Pontarlier (FR); Bernat Monferrer, St-Prex (CH); Julien Feyer, Vernier (CH); Edmond Capt, Le Brassus (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 834 days.

(21) Appl. No.: 16/378,971

(22) Filed: Apr. 9, 2019

(65) Prior Publication Data

US 2019/0332058 A1 Oct. 31, 2019

(30) Foreign Application Priority Data

Apr. 27, 2018 (EP) ..... 18169955

(51) Int. Cl.
*G04B 13/02* (2006.01)
*G04B 19/06* (2006.01)

(52) U.S. Cl.
CPC ..... *G04B 19/065* (2013.01); *G04B 13/02* (2013.01)

(58) Field of Classification Search
CPC ..... G04B 19/10; G04B 19/065; G04B 13/02
See application file for complete search history.

(56) References Cited

U.S. PATENT DOCUMENTS 3,404,527 A * 10/1968 Tripet ..... G04B 19/32 D10/122
3,878,363 A * 4/1975 Terwilliger ..... G06M 1/38 968/833

(Continued)

FOREIGN PATENT DOCUMENTS

CH 701 653 B1 2/2011
FR 2 657 439 A1 7/1991

OTHER PUBLICATIONS

European Search Report dated Oct. 30, 2018 in European Application 18169955.4, filed on April 27, 2018 (with English translation of categories of Cited Documents and Written Opinion).

(Continued)

*Primary Examiner* — Sean Kayes
(74) *Attorney, Agent, or Firm* — Oblon, McClelland, Maier & Neustadt, L.L.P.

(57) ABSTRACT

A moving mechanism for a decorative element of a timepiece, the decorative element including at least two decorative faces disposed around an arbor defining the axis of the decorative element. The moving mechanism includes a circular drive element arranged to be rotatable about a central axis and including an aperture arranged to reveal one of the decorative faces of the decorative element and inside which said decorative element is mounted to rotate about its arbor. The moving mechanism also includes first device for driving the decorative element in rotation about its arbor mounted on the circular drive element and arranged to cooperate with fixed actuation means provided in the periphery of the circular drive element, such that the decorative element rotates about its arbor to successively display its decorative faces in the aperture of the circular drive element while rotating about the central axis.

16 Claims, 6 Drawing Sheets

(56) References Cited

U.S. PATENT DOCUMENTS

| | | | | |
|---|---|---|---|---|
| 4,734,895 | A * | 3/1988 | Grosskopf | G04B 47/042 968/408 |
| 6,262,947 | B1 * | 7/2001 | Pulver | G04B 45/0092 368/232 |
| 8,199,612 | B2 * | 6/2012 | Jolidon | G04B 19/16 368/231 |
| 8,213,269 | B2 * | 7/2012 | Saunier | G04B 19/16 368/231 |
| 9,001,627 | B2 * | 4/2015 | Giguet | G04B 45/0038 368/76 |
| 9,176,477 | B2 * | 11/2015 | Muraji | G04B 45/0038 |
| 2003/0099159 | A1 * | 5/2003 | Herbstman | G04B 19/202 368/77 |
| 2011/0013495 | A1 * | 1/2011 | Saunier | G04B 19/16 368/225 |
| 2011/0069590 | A1 * | 3/2011 | Jolidon | G04B 47/042 368/190 |

OTHER PUBLICATIONS

Combined Chinese Office Action and Search Report dated Aug. 25, 2020 in corresponding Chinese Patent Application No. 201910344599.3 (with English Translation and English Translation of Category of Cited Documents), 12 pages.

* cited by examiner

MOVING MECHANISM FOR A DECORATIVE ELEMENT OF A TIMEPIECE

CROSS-REFERENCE TO RELATED APPLICATION

This application claims priority to European Patent Application No. 18169955.4 filed on Apr. 27, 2018, the entire disclosure of which is hereby incorporated herein by reference.

FIELD OF THE INVENTION

The invention relates to a moving mechanism for a decorative element of a timepiece, said decorative element comprising at least two decorative faces disposed around an arbor defining the axis of said decorative element.

BACKGROUND OF THE INVENTION

A moving mechanism of this type is described, for example, in Swiss Patent No. CH684814. The decorative element is formed of a stud rotating about its axis and having the shape of a cube or a triangular right prism whose faces disposed around the axis of rotation are set with various precious stones of different colours. The timepiece includes, for example, twelve studs, each of the studs corresponding to an hour position on the hour circle. The studs are driven in rotation about their respective axes by means of a rotating crown in such a way as to successively reveal the faces of the studs to give the hour circle a different appearance. However, with such a mechanism, motion is limited, since the studs can move only in a single movement about their respective axis.

SUMMARY OF THE INVENTION

It is an object of the present invention to overcome the aforecited drawbacks by proposing a moving mechanism for timepieces able to move a decorative element in different combined movements in order to create a complex and captivating motion.

To this end, the invention relates to moving mechanism for a decorative element of a timepiece, said decorative element including at least two decorative faces disposed around an arbor defining the axis of said decorative element.

According to the invention, said moving mechanism includes a circular drive element arranged to be rotatable about a central axis and including an aperture arranged to reveal one of the decorative faces of the decorative element and inside which said decorative element is rotatable about its arbor, and first means for driving said decorative element in rotation about its arbor, mounted on the circular drive element and arranged to cooperate with fixed actuation means provided in the periphery of the circular drive element, such that said decorative element rotates about its arbor and/or moves along its arbor to successively display its decorative faces in the aperture of the circular drive element while rotating about the central axis.

The moving mechanism of the invention allows a decorative element to be moved in two combined movements, thereby creating a complex motion.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
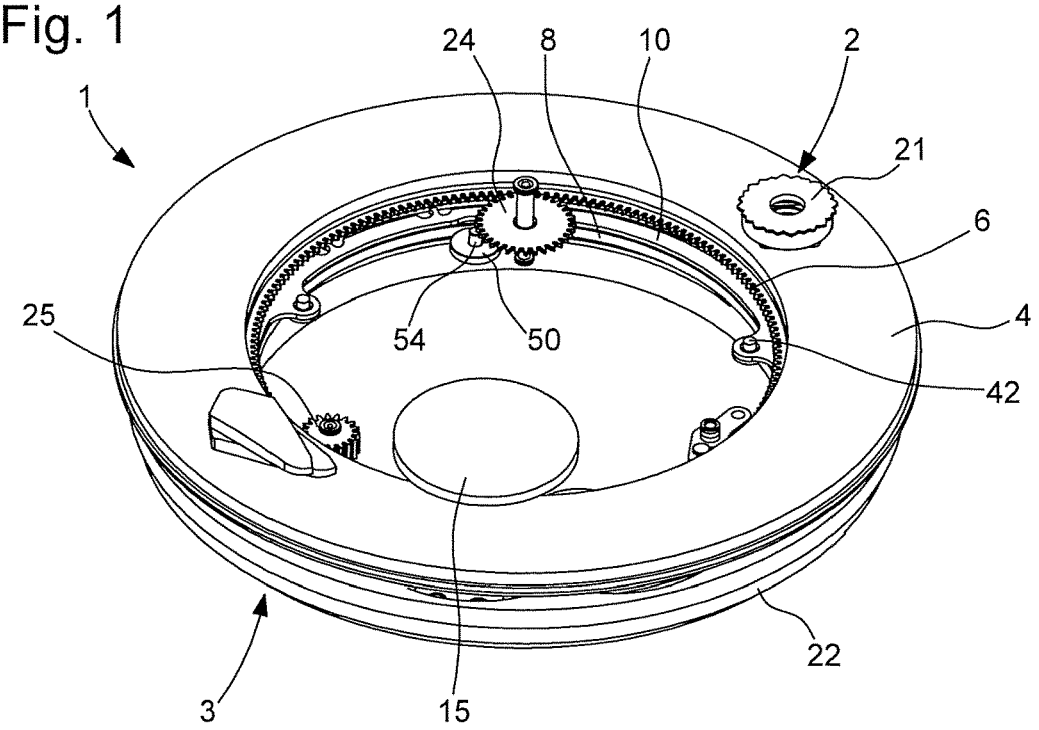
FIG. 1 is a perspective view of a moving mechanism according to the invention.

Referring to FIG. 1, moving mechanism 1 for a decorative element 2 of a timepiece includes a circular drive element 3, arranged to carry said decorative element 2. In the example represented here, circular drive element 3 is sized to correspond to the timepiece dial. It is clear that, in another, non-represented variant, the circular drive element could be sized to occupy only part of the timepiece dial. In the variant represented, circular drive element 3 is hollowed at its centre so that it is of annular shape. Consequently, in the following description, the terms "circular drive element" and "annular drive element" will be used alike to designate the part referenced 3.

Figure 4:
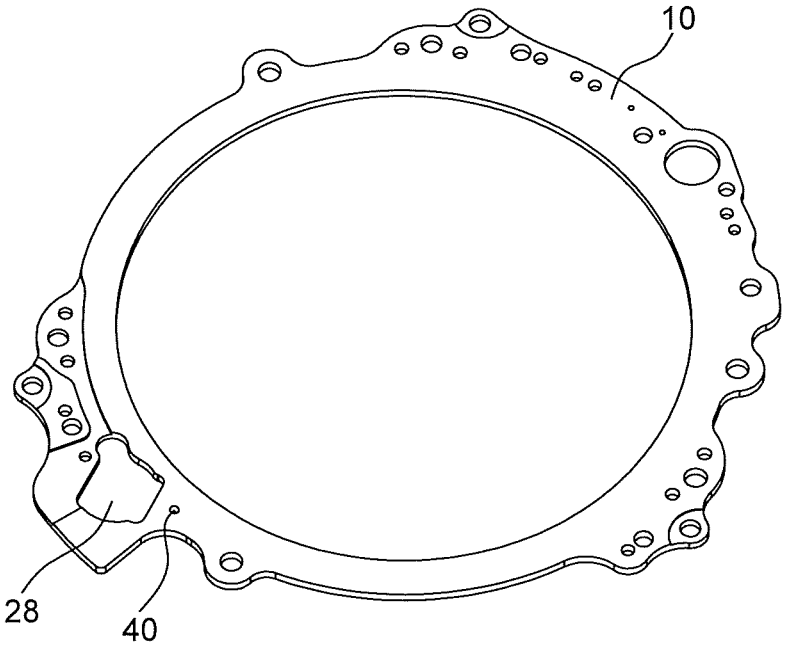
FIG. 4 is a perspective view of the rotor bridge.
Figure 5:
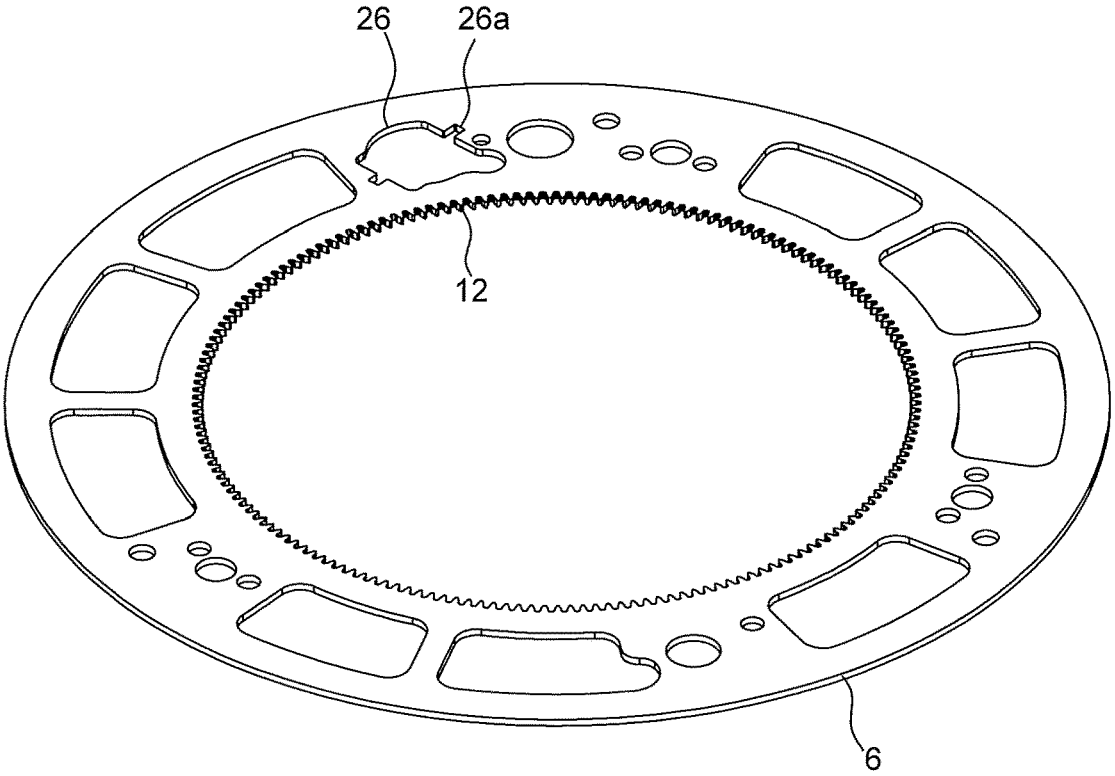
FIG. 5 is a perspective view of the drive crown.
Figure 6:
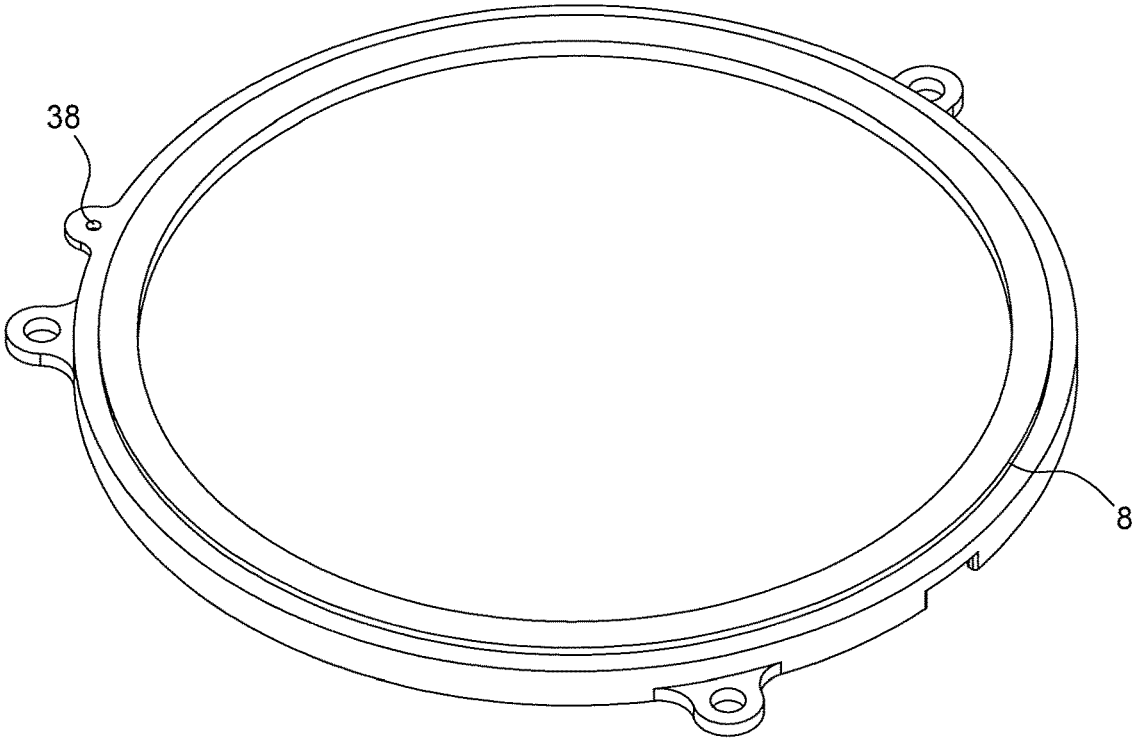
FIG. 6 is a perspective view of the rotor.

Advantageously, circular drive element 3 includes a movable dial 4, a drive crown 6, in addition to a rotor 8 and a rotor bridge 10, of annular shape, as more particularly shown in FIGS. 4 to 6. Rotor 8, rotor bridge 10, drive crown 6 and movable dial 4 are superposed and integrally mounted with each other. Crown 6 is disposed between movable dial 4 and rotor bridge 10.

In the variant represented here, drive crown 6 has an inner toothing 12 disposed on its inner peripheral edge, whose purpose will be described hereinafter.

Movable dial 4, drive crown 6, rotor 8 and rotor bridge 10 are arranged to carry decorative element 2 and its rotational drive means, referred to as the 'first drive means', as will be described hereinafter.

The hollow centre of annular drive element 3 is filled by a fixed dial 14 (cf. FIG. 9), integral with the frame and traversed by the arbor of the hands (not shown) for displaying the hours and minutes. Fixed dial 14 can bear fixed decorative elements 15, positioned entirely on fixed dial 14 or in such a way as to be partially above annular drive element 3.

Figure 2:
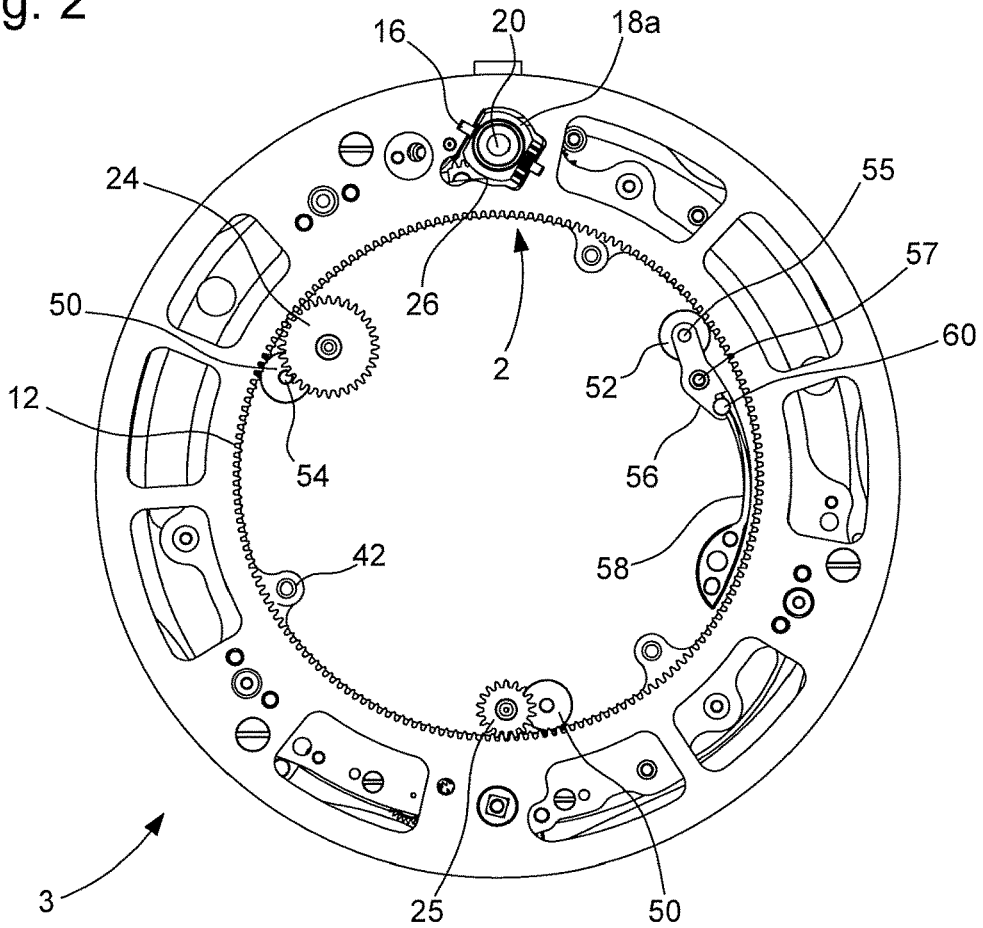
FIG. 2 is a top view of the moving mechanism of the invention, with the movable dial removed.
Figure 3:
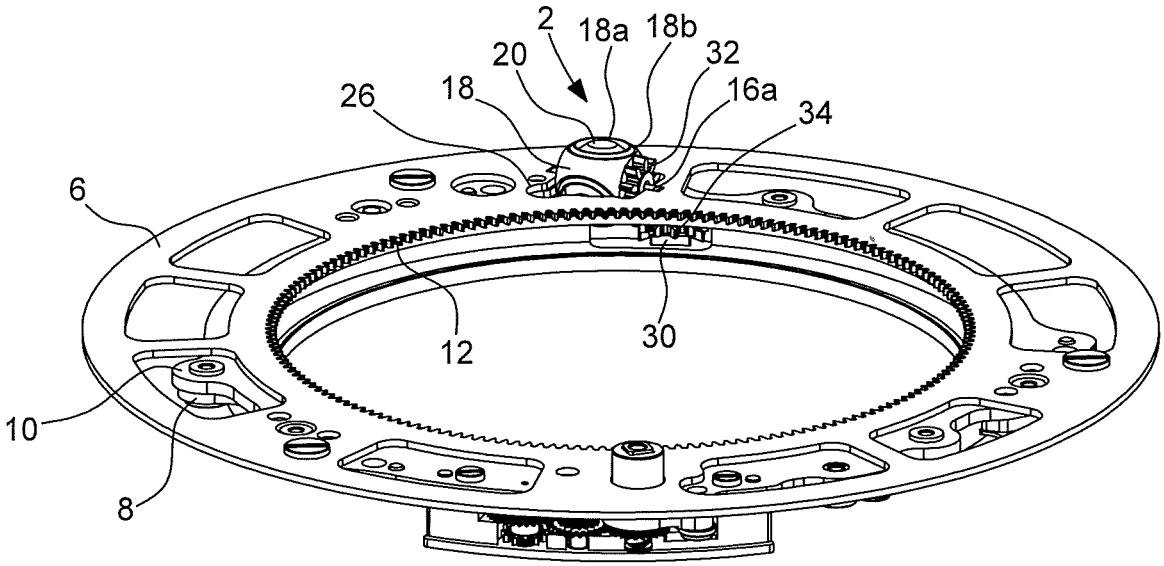
FIG. 3 is a perspective view of the circular drive element and of the decorative element.
Figure 8:
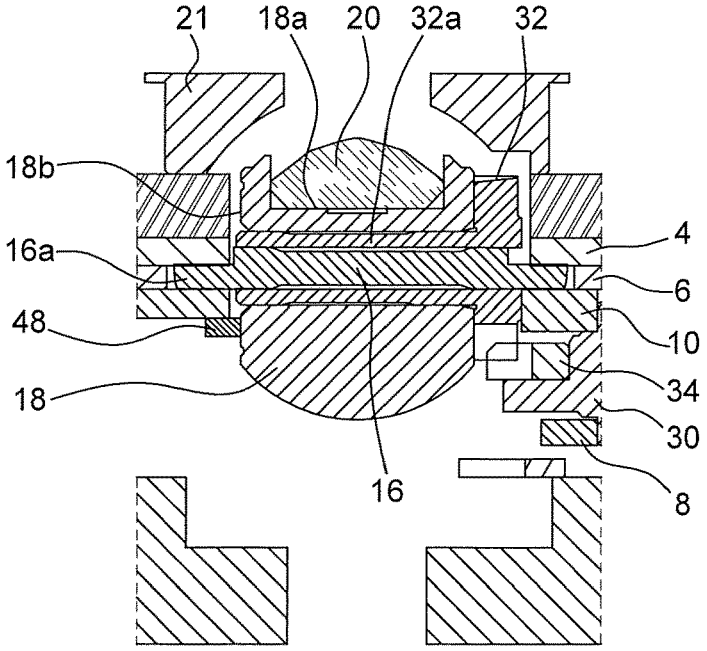
FIG. 8 is a sectional view of the circular drive element and of the decorative element.

Referring to FIGS. 2, 3 and 8, decorative element 2 includes at least two decorative faces disposed around an arbor 16 defining the axis of rotation of said decorative element 2.

Preferably, the decorative faces of decorative element 2 are decorated differently from each other to provide a different visual appearance.

Advantageously, decorative element 2 includes a stone-holder 18 carrying stones 20 forming the decorative element 2 and a finishing element 21 disposed on movable dial 4 and surrounding stone-holder 18.

In the example represented, stone-holder 18 has three decorative faces 18*a* disposed at substantially 120° with respect to each other around arbor 16, each face 18*a* being occupied by a stone 20, and two parallel faces 18*b* through which said arbor 16 passes perpendicularly.

Advantageously, stones 20 are of different colours to form three decorative faces 18*s* different from each other. For example, precious stones, such as ruby, emerald and diamond could be used.

According to the invention, circular drive element 3 is arranged to be rotatable about its axis, which is perpendicular to the plane defined by the circular drive element, said axis being referred to as the central axis. The central axis is preferably parallel to the axis of the hands and it may be different from the axis of the timepiece case. To this end, circular drive element 3 is mounted to pivot on a frame 22 of the timepiece.

Figure 10:
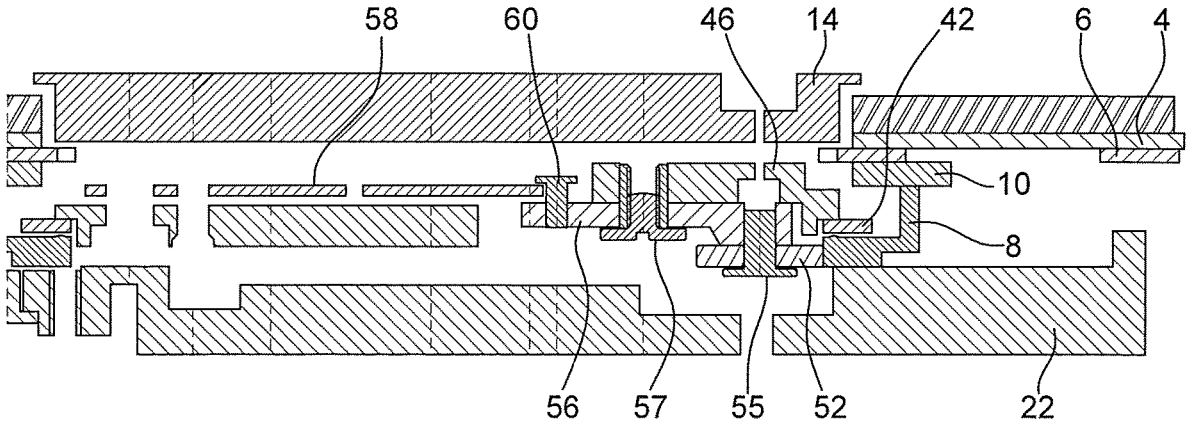
FIG. 10 is a sectional view of the mobile runner.

Preferably, circular drive element 3 is held radially on frame 22 by at least two runners mounted on the frame, one of the runners being fixed and the other runner being mobile. In the present example, and with reference to FIGS. 2 and 10, there are three runners 50, 52 positioned inside annular drive element 3 at around 120°, two runners 50 being fixed and the third runner 52 being mobile. The two fixed runners 50 are mounted to pivot on a pin 54 fixed to plate 46, in contact with rotor 8. The third, mobile runner 52 is mounted to pivot about an axis 55, on a mobile runner support 56. Said mobile runner support 56 is in turn mounted to pivot on plate 46 about an axis 57, allowing mobile runner 52 to come into contact with rotor 8. A mobile runner spring 58 is mounted on the frame, its free end resting on a support member 60 arranged on mobile runner support 56. Mobile runner 52 takes up assembly play in annular drive element 3, removing any unwanted radial motion and ensuring optimum performance.

Circular drive element 3 is arranged to cooperate with rotational drive means (referred to as the 'second drive means') about the central axis.

Advantageously, said second means for driving circular drive element 3 in rotation about the central axis are arranged to cooperate with drive crown 6. More precisely, the second means for rotational driving of circular drive element 3 about the central axis include a wheel set 24 of a going train cooperating with a barrel (not represented), which is the energy source for powering the moving mechanism. Said wheel set 24 is preferably disposed on the frame in proximity to the inner peripheral edge of drive crown 6, in order to mesh with internal toothing 12 and drive in rotation drive crown 6, and thereby the entire first drive means for annular drive element 3. An intermediate wheel 25 cooperating with a governor i.e. a speed regulator (not represented) is also provided. Said intermediate wheel 25 is disposed on the frame preferably in proximity to the inner peripheral edge of drive crown 6 in order to mesh with internal toothing 12 and to regulate the rotational speed of drive crown 6, and thereby of all the elements of annular drive element 3. It is clear that it is also possible to provide a main gear train from the barrel to the governor and a secondary gear train from the main train to the moving mechanism.

Circular drive element 3, and more particularly drive crown 6, includes an aperture 26 arranged to reveal one of decorative faces 18*a* of decorative element 2 and inside which said decorative element 2 is mounted to be rotatable about its arbor 16. To this end, stone-holder 18 is mounted for free rotation about arbor 16 and said arbor 16 is held on drive crown 6 between rotor bridge 10 and movable dial 4, as shown in FIG. 8, by its ends 16*a* which each have a flat portion disposed inside a corresponding housing 26*a* formed inside aperture 26, as shown in FIG. 5. Rotor bridge 10 also has an aperture 28, disposed opposite aperture 26, and inside which the non-visible part of stone-holder 18 is housed and is free to move.

Arbor 16 is thus disposed here in a plane perpendicular to the central axis. According to another variant, the design can be modified to provide an inclined arbor 16. Further, arbor 16 may or may not be disposed radially to the central axis.

Decorative element 2 is driven in rotation about its arbor 16 by first rotational drive means mounted on annular drive element 3 and arranged to cooperate with fixed actuation means provided in the periphery of annular drive element 3, such that said decorative element 2 rotates about its arbor 16 to successively display its decorative faces 18*a* in aperture 26 of circular drive element 3 while rotating about the central axis.

Advantageously, the first drive means comprise a Maltese cross 30 arranged to cooperate with the fixed actuation means and a gear train, comprising at least a first intermediate wheel 32 and a second intermediate wheel 34, kinematically connecting said Maltese cross 30 to decorative element 2.

Referring to FIG. 8, first intermediate wheel 32 rests on one of faces 18*b* of stone-holder 18*a* and includes a hollow arbor 32*a* mounted through stone-holder 18 coaxially to arbor 16. Said arbor 32*a* is integral with stone-holder 18*a* and is mounted to pivot about arbor 16, such that stone-holder 18, integral with first intermediate wheel 32, rotates with said first intermediate wheel 32 and its arbor 32*a* about arbor 16, i.e. in a plane perpendicular to the central axis here.

Figure 9:
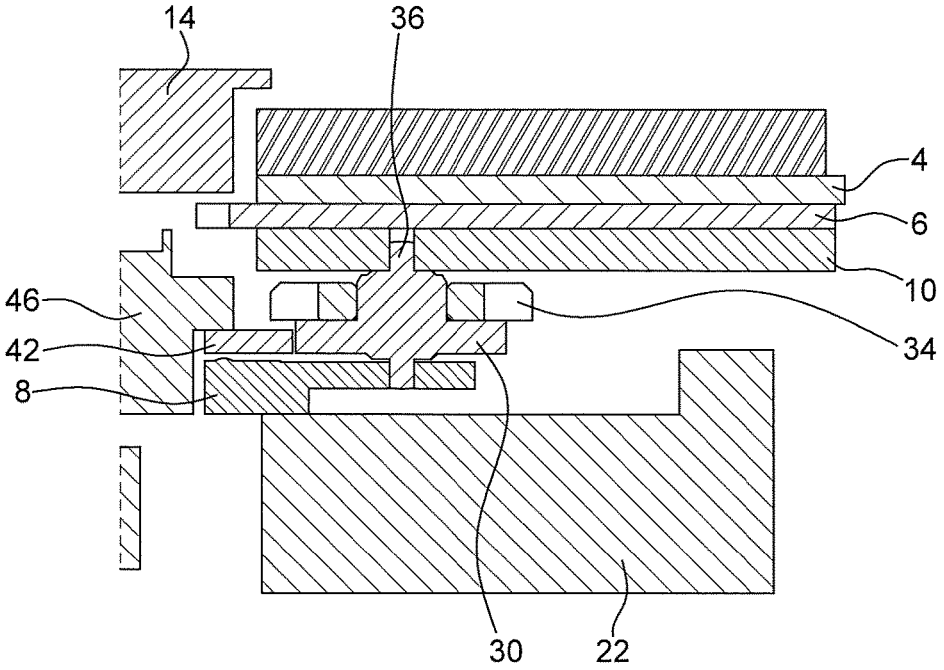
FIG. 9 is a sectional view of the circular drive element with the Maltese cross and the fixed cam.

Second intermediate wheel 34 is mounted integrally on Maltese cross 30 As shown in FIGS. 8 and 9, Maltese cross 30 and second intermediate wheel 34 are mounted together to pivot on circular drive element 3, on an axis parallel to the central axis. More specifically, Maltese cross 30 and second intermediate wheel 34 are mounted together between rotor 8 and rotor bridge 10, so that they are mounted a embarked on circular drive element 3. The ends of arbor 36 of Maltese cross 30 are respectively disposed inside an orifice 38 arranged on rotor 8 and inside an orifice 40 arranged opposite on rotor bridge 10, in proximity to decorative element 2 such that second intermediate wheel 34 meshes with first intermediate wheel 32 in a spur, conical or helical gear preferably at 90°.

Figure 7:
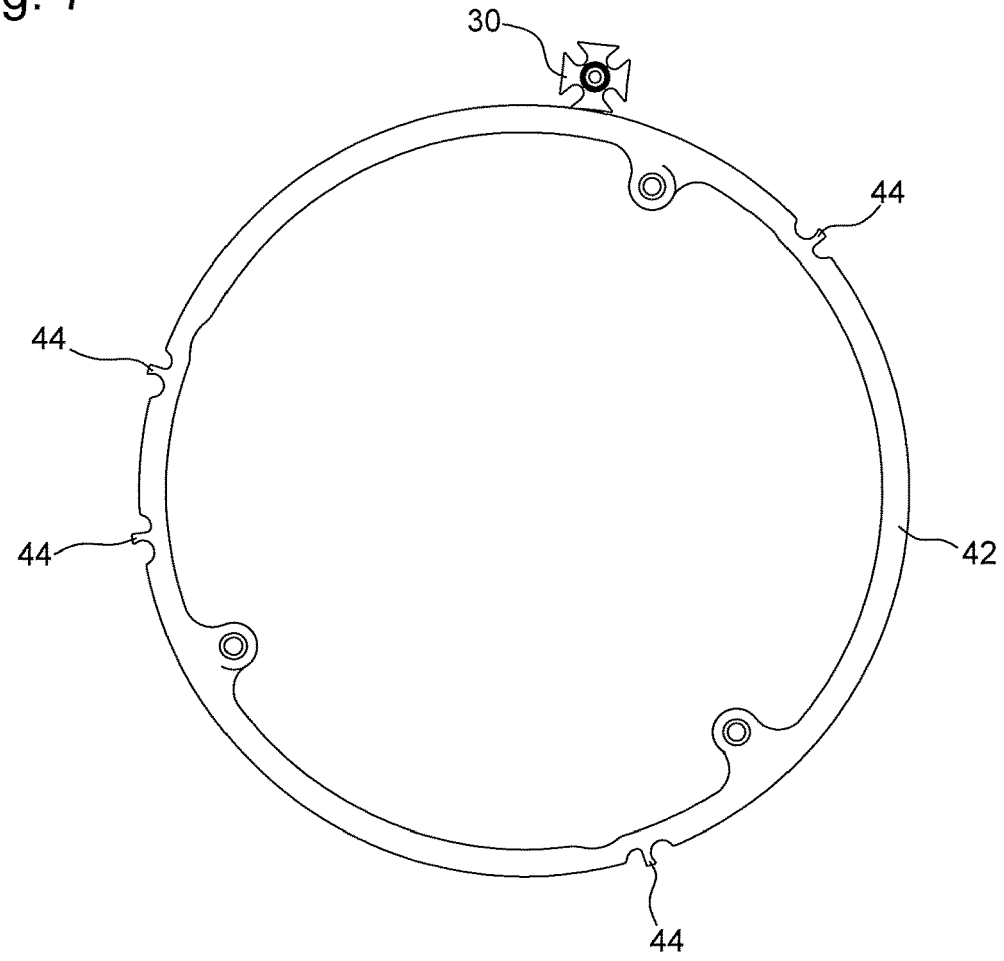
FIG. 7 is a top view of the fixed cam and the Maltese cross.

Advantageously, the actuation means cooperating with Maltese cross 30 include a cam 42 concentric to circular drive element 3 and fixedly mounted on the frame, for example the plate 46 of the movement (cf. FIG. 9). Referring to FIG. 7, said cam 42 includes on its outer edge at least one tooth 44 arranged to actuate the first drive means, and more particularly to control Maltese cross 30.

The profile of each branch of Maltese cross 30 is arranged to correspond to the circular profile of cam 42, such that the angular position of Maltese cross 30 does not change as long as the profile of one of its branches is as close as possible to the circular part of cam 42. When Maltese cross 30 mounted on rotating circular drive element 3 meets a tooth 44 of fixed cam 42, it makes a rotation of preferably 90° until it is locked again by the circular profile of cam 42.

A friction spring 48 is mounted underneath rotor bridge 10, with its free end in contact with the face 18*b* of stone-holder 18 opposite the face 18*b* against which first intermediate wheel 32 rests. Friction spring 48 acts like a training pad on stone-holder 18 to remove any shake or unwanted motion which could interfere with Maltese cross 30 meshing on each of teeth 44 of cam 42.

Cam 42 includes a number n of teeth 44 distributed over its outer edge allowing n rotations of decorative element 2 per revolution of circular drive element 3. Teeth 44 may be distributed over cam 42 in a regular manner, allowing regular and continuous rotation of Maltese cross 30 and thus of decorative element 2 during rotation of circular drive element 3. Teeth 44 may also be distributed over cam 42 in an irregular manner, for example as shown in FIG. 7, allowing discontinuous rotation of Maltese cross 30 and thus of decorative element 2 during rotation of circular drive element 3.

Advantageously, decorative element 2 includes m decorative faces, where m is equal to or different from n. Preferably, m is different from n. Thus, for example, in the example shown, decorative element 2 has three decorative faces 18*a* while cam 42 has four teeth 44, which means that, when circular drive element 3 rotates, decorative element 2 can have a different rotational sequence of its decorative faces from the preceding revolution.

Drive element 3 of the moving mechanism can be supplied with energy by at least one autonomous energy accumulator, such as a barrel, independent of the energy accumulator of the movement, its speed being regulated by a governor. The barrel is arranged to be kinematically connected to wheel set 24 of the going train and the governor is kinematically connected to intermediate wheel 25.

Advantageously, the moving mechanism according to the invention can be started and stopped by an independent control mechanism of the timepiece movement.

Advantageously, such a control mechanism comprises control means arranged to exert two functions, namely first control means arranged to exert a first function consisting in starting (GO) and stopping (STOP) the moving mechanism on demand of the user; and second control means arranged to exert a second function consisting in stopping the moving mechanism when the energy of the autonomous energy accumulator is too low to ensure a good speed and proper operation of the moving mechanism, and when the energy remaining reaches a determined energy threshold. This second function allows the moving mechanism to stop by itself even if the user has not given the STOP instruction.

To perform the first STOP & GO function, the first control means of the control mechanism can include a pusher crown provided with a STOP & GO push button, a column wheel able to move between a position STOP for stopping the moving mechanism and a position GO for starting the moving mechanism, said column wheel cooperating, on the one hand with an actuation lever actuated by the push button and, on the other hand, with a first locking lever arranged to feel the STOP and GO positions of the column wheel and move between a governor locking position, for example, by locking intermediate wheel 25 which is kinematically connected to the governor, when the STOP position of the column wheel is detected; and an operating position in which said intermediate wheel 25 is not locked, and thus the governor is free, when the GO position of the column wheel is detected.

Figure 11:
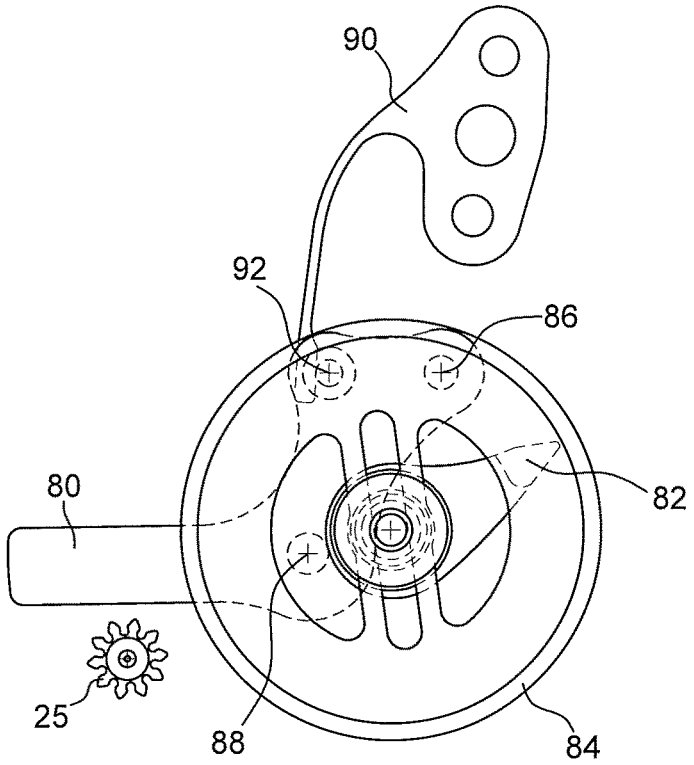
FIG. 11 is a view of the second control means of the moving mechanism control mechanism in the operating position.
Figure 12:
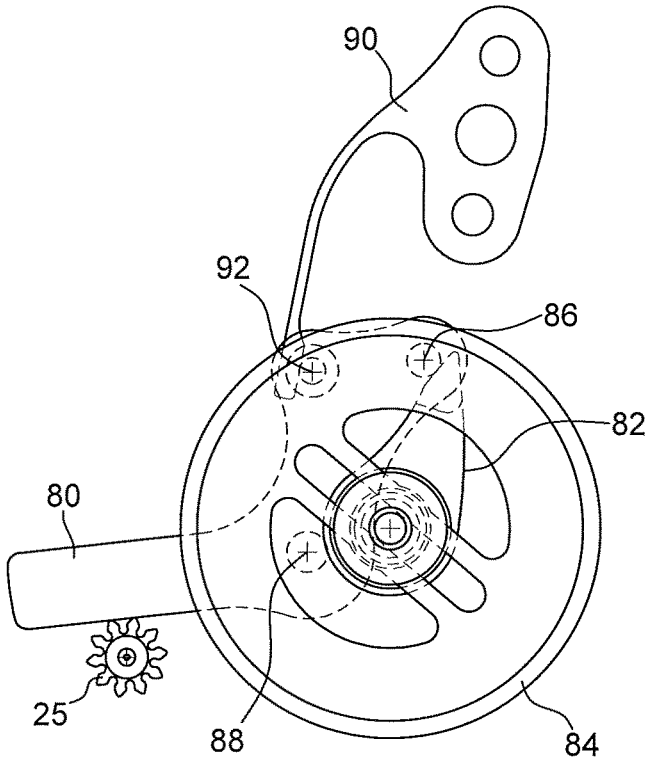
FIG. 12 is a view of the second control means of the moving mechanism control mechanism in the governor locking position.

To perform the second stop function when the energy in the barrel becomes insufficient, the second control means of the control mechanism can include, as represented in FIGS. 11 and 12, a second locking lever 80 arranged to move between an operating position (cf. FIG. 11) in which the intermediate wheel 25 kinematically connected to the governor is not locked, so that the governor is free, when the energy in the accumulator is higher than a determined threshold; and a governor locking position (cf. FIG. 12), for example, by locking said intermediate wheel 25, when the accumulator energy reaches said determined threshold. To this end, there is provided a power reserve finger 82 integrally mounted on a power reserve display wheel set 84 kinematically connected to the energy accumulator, said power reserve finger 82 being arranged to press on a pin 86 provided on second locking lever 80, when the determined energy threshold is reached. When power reserve finger 82 presses on pin 86, second locking lever 80 tilts about its axis 88 into the locking position in order to lock intermediate wheel set 25, as shown in FIG. 12. When the energy accumulator is wound and the energy in the accumulator becomes higher than the determined threshold again, power reserve finger 82, driven by power reserve wheel set 84, moves away from pin 86, such that second locking lever 80 moves away from intermediate wheel 25 and returns to its operating position, as shown in FIG. 11. There is provided a spring 90, whose free end cooperates with a pin 92 arranged on second locking lever 80 in order to tilt said second locking lever 80 and return it to the operating position when power reserve finger 82 is no longer pressing on pin 86. This control mechanism allows the moving mechanism to restart without delay as soon as the user starts to wind the energy accumulator in the case where the push button is in the GO position.

To operate the moving mechanism according to the invention, the control mechanism is actuated by pressing on the push button in the GO position. Annular drive element 3 is then rotated via wheel set 24 meshing with drive crown 6 and carries therewith decorative element 2 and first rotational drive means 30, 32, 34. When Maltese cross 30, mounted on annular drive element 3 passes before a tooth 44 of fixed cam 32, Maltese cross 30 pivots 90°. The changes in angular position of Maltese cross 30 are then transmitted to decorative element 2, via second intermediate wheel 34 and first intermediate wheel 32, so as to drive decorative element 2 in rotation about its arbor 16, preferably through an angle of 120°, four times per revolution of circular drive element 3. Thus, decorative element 2 makes a combined movement, on the one hand rotating about its arbor 16 to successively display its decorative faces 18*a* in aperture 26 of annular drive element 3, and on the other hand, rotating with annular drive element 3 about the central axis.

The invention is not limited to the example described. In particular, the drive crown could have a toothing on its outer edge, with the second drive means arranged accordingly. Moreover, circular drive element 3 may be solid, the runners then being replaced by another radial holding system, of the bearing type for example, or arranged outside circular drive element 3.

The invention claimed is:

1. A moving mechanism for a decorative element of a timepiece, said decorative element comprising at least two decorative faces disposed around an arbor defining the axis of said decorative element, wherein said moving mechanism includes a circular drive element arranged to be rotatable about a central axis and including an aperture arranged to reveal one of the decorative faces of the decorative element and inside which said decorative element is mounted to rotate about its arbor, and first means for driving said decorative element in rotation about its arbor mounted on the circular drive element and arranged to cooperate with fixed actuation means provided in the periphery of the circular drive element such that said decorative element rotates about its arbor to successively display its decorative faces inside the aperture of the circular drive element while rotating about the central axis.

2. The moving mechanism according to claim 1, wherein the first drive means include a Maltese cross arranged to cooperate with the fixed actuation means and a gear train, including at least a first intermediate wheel and a second intermediate wheel kinematically connecting said Maltese cross to the decorative element.

3. The moving mechanism according to claim 2, wherein the tooth is arranged to control the Maltese cross.

4. The moving mechanism according to claim 2, wherein the decorative element includes comprises a stone-holder carrying stones forming the decorative faces of the decorative element, said stone-holder being integral with the first intermediate wheel of the gear train, said stone-holder and said first intermediate wheel being mounted to pivot about the arbor of the decorative element.

5. The moving mechanism according to claim 1, wherein the actuation means include a cam concentric with the circular drive element and fixedly mounted on a frame, said cam comprising on its outer edge at least one tooth arranged to actuate the first drive means.

6. The moving mechanism according to claim 5, wherein the cam comprises a number n of teeth distributed over its outer edge allowing n rotations of the decorative element per revolution of the circular drive element.

7. The moving mechanism according to claim 6, wherein the decorative element includes comprises m decorative faces wherein m is equal to or different from n.

8. The moving mechanism according to claim 1, wherein the decorative faces of the decorative element are decorated differently from each other.

9. The moving mechanism according to claim 1, wherein the circular drive element is hollow at the centre thereof to be annular in shape and includes a drive crown.

10. The moving mechanism according to claim 9, wherein the mechanism includes second means for driving the circular drive element in rotation about the central axis arranged to cooperate with the drive crown.

11. The moving mechanism according to claim 1, wherein the circular drive element is held radially on the frame by at least two runners mounted on a frame, one of the runners being fixed and the other runner being mobile.

12. A timepiece comprising a moving mechanism for a decorative element of a timepiece, said decorative element including at least two decorative faces disposed around an arbor defining the axis of said decorative element, wherein said moving mechanism includes a circular drive element arranged to be rotatable about a central axis and including an aperture arranged to reveal one of the decorative faces of the decorative element and inside which said decorative element is mounted to rotate about its arbor, and first means for driving said decorative element in rotation about its arbor mounted on the circular drive element and arranged to cooperate with fixed actuation means provided in the periphery of the circular drive element such that said decorative element rotates about its arbor to successively display its decorative faces inside the aperture of the circular drive element while rotating about the central axis.

13. The timepiece according to claim 12, wherein the timepiece includes at least one energy accumulator for supplying the moving mechanism with energy, a governor for the moving mechanism, and a control mechanism for the moving mechanism, said control mechanism including first control means arranged to start and stop the moving mechanism on demand by a user, and second control means arranged to stop the moving mechanism when the energy remaining in the energy accumulator reaches a determined energy threshold.

14. The timepiece according to claim 13, wherein the first control means of the control mechanism comprise a push button, a column wheel cooperating with said push button to move between a position STOP for stopping the moving mechanism and a position GO for starting the moving mechanism, and a first locking lever arranged to feel the STOP position and the GO position of the column wheel and to move between a governor locking position when the STOP position of the column wheel is detected, and an operating position wherein said governor is free when the GO position of the column wheel is detected.

15. The timepiece according to claim 13, wherein the second control means of the control mechanism include a second locking lever arranged to move between an operating position wherein the governor is free, when the energy in the accumulator is higher than a determined threshold, and a governor locking position when the energy in the accumulator reaches said determined threshold.

16. The timepiece according to claim 15, wherein the timepiece includes a power reserve finger integrally mounted on a power reserve display wheel set kinematically connected to the energy accumulator, said power reserve finger being arranged to press on the second locking lever when the determined energy threshold is reached and to move said locking lever into its governor locking position.

* * * * *